US008826779B2

(12) United States Patent
Chen

(10) Patent No.: US 8,826,779 B2
(45) Date of Patent: Sep. 9, 2014

(54) ADJUSTABLE WRENCH

(76) Inventor: Kung-Cheng Chen, Taichung (TW)

( * ) Notice: Subject to any disclaimer, the term of this patent is extended or adjusted under 35 U.S.C. 154(b) by 357 days.

(21) Appl. No.: 13/326,838

(22) Filed: Dec. 15, 2011

(65) Prior Publication Data

US 2013/0068071 A1 Mar. 21, 2013

(30) Foreign Application Priority Data

Sep. 16, 2011 (TW) ..... 100133357 A

(51) Int. Cl.
*B25B 13/14* (2006.01)
*B25B 13/46* (2006.01)

(52) U.S. Cl.
CPC ..... *B25B 13/14* (2013.01); *B25B 13/46* (2013.01)
USPC ..... 81/165; 81/179; 81/186

(58) Field of Classification Search
USPC ..... 81/165, 170, 179, 186
See application file for complete search history.

(56) References Cited

U.S. PATENT DOCUMENTS 4,706,528 A * 11/1987 Inoue ..... 81/179
7,827,887 B2 * 11/2010 Lee ..... 81/179
8,408,101 B2 * 4/2013 Liu ..... 81/179

* cited by examiner

*Primary Examiner* — Hadi Shakeri
(74) *Attorney, Agent, or Firm* — Bacon & Thomas, PLLC

(57) ABSTRACT

An adjustable wrench has a wrench body, a clamping element and a ratcheting jaw. The wrench body has a handle, a head and a thumbscrew. The head is formed on a front end of the handle and has a connecting block, a fixed jaw, a curved slot, a positioning pin, a mounting recess and a sliding slot. The clamping element is movably connected to the wrench body and has a rear end, a front end, a sliding bar and a movable jaw. The sliding bar is formed on the rear end of the clamping element, is mounted in the sliding slot and engages the thumbscrew and has multiple teeth. The ratcheting jaw is a curved block capable of sliding forward and retracting backward inside the curved slot and has a backward area, a forward area, a guide hole, an engaging surface, an abutting surface, an engaging protrusion and a spring.

8 Claims, 9 Drawing Sheets

ADJUSTABLE WRENCH

BACKGROUND OF THE INVENTION

1. Field of the Invention

The present invention relates to an adjustable wrench, and more particularly to an adjustable wrench that can hold a hexangular head of a bolt securely and can be operated with bolts of different sizes smoothly.

2. Description of Related Art

A conventional adjustable wrench as disclosed in U.S. Pat. No. 6,739,223 comprises a handle, a fixed jaw, a roller and a movable jaw. The fixed jaw is formed on an end of the handle and has a curved inner side. The roller is rotatably mounted in the curved inner side of the fixed jaw to rotate in an opposite direction relative to the handle. The movable jaw is slideably mounted on the end of the handle, faces the fixed jaw and the roller to hold and rotate a hexangular head of a bolt in a backward or a forward direction.

Although the conventional adjustable wrench can be used to rotate bolts of different sizes in the backward or the forward direction, the rotating direction of the roller is opposite to the rotating direction of the conventional adjustable wrench when the handle is rotated in a backward direction. Then, the conventional adjustable wrench cannot rotate backwardly with a smaller range of movement.

In addition, the movable jaw of the conventional adjustable wrench does not have a structure to block the hexangular head of the bolt. With reference to the FIG. 8 of the above-mentioned patent, when the conventional adjustable wrench is used to rotate a small-size bolt, the engaging position between the hexangular head of the small-size bolt and the jaws of the conventional adjustable wrench is deeper than the engaging position between the hexangular head of the ordinary-size bolt and the jaws of the conventional adjustable wrench. When the conventional adjustable wrench is rotated, the corners of the hexangular head of the small-size bolt may be worn and torn by the jaws of the conventional adjustable wrench. Furthermore, when the bolt is rotated with the jaws of the conventional adjustable wrench, the conventional adjustable wrench does not have a notch to yield the corners of an ordinary-size bolt and this will make the corners of the ordinary-size bolt broken.

To overcome the shortcomings, the present invention provides an adjustable wrench to mitigate or obviate the aforementioned problems.

SUMMARY OF THE INVENTION

The main objective of the present invention is to provide an adjustable wrench that can hold a hexangular head of a bolt securely and can be operated with bolts of different sizes smoothly.

The adjustable wrench in accordance with the present invention has a wrench body, a clamping element and a ratcheting jaw. The wrench body has a handle, a head and a thumbscrew. The head is formed on a front end of the handle and has a connecting block, a fixed jaw, a curved slot, a positioning pin, a mounting recess and a sliding slot. The clamping element is movably connected to the wrench body and has a rear end, a front end, a sliding bar and a movable jaw. The sliding bar is formed on the rear end of the clamping element, is mounted in the sliding slot and engages the thumbscrew and has multiple teeth. The ratcheting jaw is a curved block capable of sliding forward and retracting backward inside the curved slot and has a backward area, a forward area, a guide hole, an engaging surface, an abutting surface, an engaging protrusion and a spring.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
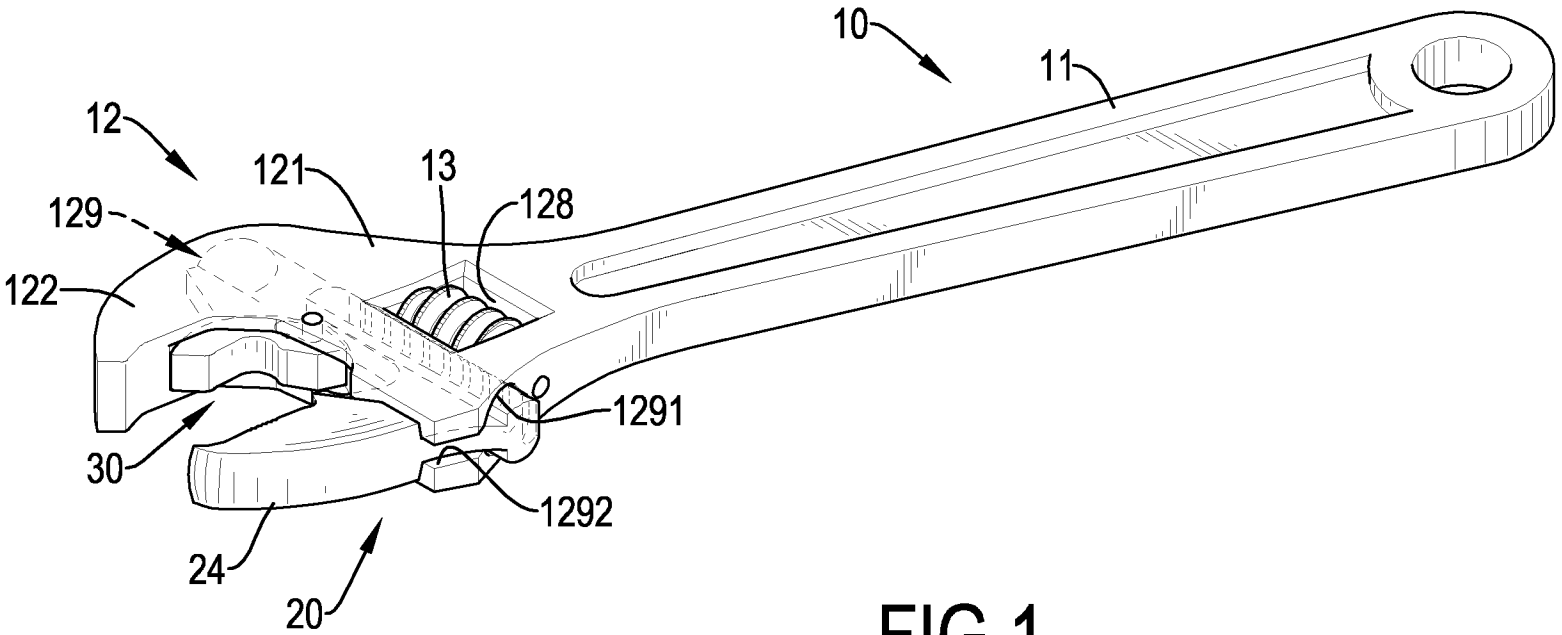
FIG. 1 is a perspective view of a first embodiment of an adjustable wrench in accordance with the present invention.
Figure 2:
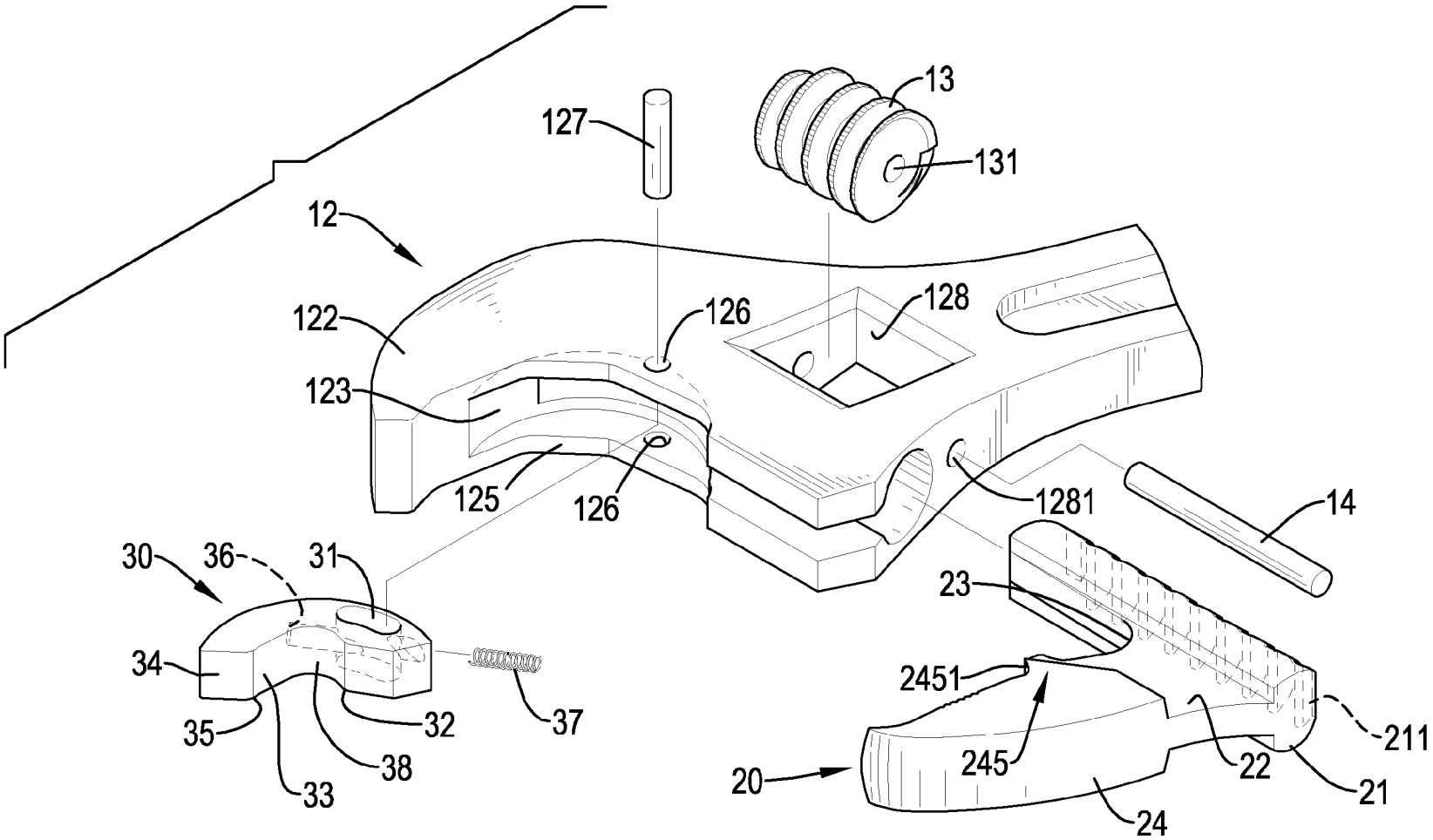
FIG. 2 is an enlarged and exploded perspective view of the adjustable wrench in FIG. 1.

With reference to FIGS. 1 to 5, a first embodiment of an adjustable wrench in accordance with the present invention comprises a wrench body 10, a clamping element 20 and a ratcheting jaw 30.

The wrench body 10 has a handle 11, a head 12, a thumbscrew 13 and an inserting pin 14. The handle 11 has a front end and a rear end.

The head 12 is formed on the front end of the handle 11 and has a top side, a bottom side, a connecting block 121, a fixed jaw 122, a curved slot 123, two sidewalls 125, two pin holes 126, a positioning pin 127, a mounting recess 128 and a sliding slot 129. The connecting block 121 is formed on and protrudes from the front end of the handle 11 and has an upper side, a front side, a top side and a bottom side. The fixed jaw 122 is formed on and protrudes from the upper side of the connecting block 121 and has an inner side.

The curved slot 123 is formed in the connecting block 121 and the fixed jaw 122 between the front side of the connecting block 121 and the inner side of the fixed jaw 122 and has an inner surface, a forward end and a backward end. The inner surface of the curved slot 123 is curved and may be a single curved surface or a multi-curved surface. The forward end of the curved slot 123 is formed in the front side of the connecting block 121 and is opposite to the fixed jaw 122. The backward end of the curved slot 123 is formed in the inner side of the fixed jaw 121. In the present invention, a backward end is defined as an end heading toward the backward direction during a ratcheting rotation of the head 12 in the backward direction. Opposite to the backward end, a forward end is defined as an end heading toward the forward direction while the head 12 is being rotated in the forward direction.

The sidewalls 125 are respectively formed on the top side and the bottom side of the head 12 beside the curved slot 123 and each sidewall 125 has a middle. The pin holes 126 are respectively formed through the middles of the sidewalls 125 and communicate with the curved slot 123. The positioning pin 127 may be a rivet or a screw and is inserted through the pin holes 126 and the curved slot 123. The mounting recess 128 may be rectangular and is formed though the top side and the bottom side of the connecting block 121 and has two opposite inner sides and two inserting holes 1281. The opposite inner sides of the mounting recess 128 face to each other. The inserting holes 1281 are respectively formed through the opposite inner sides of the mounting recess 128, are formed through the connecting block 121 and align with each other.

The sliding slot 129 is formed though the front side of the connecting block 121, communicates with the curved slot 123 and the mounting recess 128 and has a bar-shaped slot 1291 and a board-shaped slot 1292. The bar-shaped slot 1291 is formed though the connecting block 121 and communicates with the mounting recess 128. The board-shaped slot 1292 is formed through the front side of the connecting block 121 and communicates with the curved slot 123 and the bar-shaped slot 1291.

The thumbscrew 13 is rotatably mounted in the mounting recess 128 of the head 12, extends into the bar-shaped slot 1291 of the sliding slot 129 and has an axial line and a pivot hole 131. The pivot hole 131 is axially formed through the thumbscrew 13 along the axial line and aligns with the inserting holes 1281 of the mounting recess 128. The inserting pin 14 is mounted in the inserting holes 1281 of the head 12 and through the pivot hole 131 of the thumbscrew 13 to enable the thumbscrew 13 to be rotatably mounted in the head 12. In addition, the front side of the connecting block 121 parallels with the thumbscrew 13 and the inserting pin 14.

The clamping element 20 is movably connected to the wrench body 10 and has a rear end, a front end, a sliding bar 21, a ribbed slab 22 and a movable jaw 24. The sliding bar 21 is formed on the rear end of the clamping element 20, is slideably mounted in the bar-shaped slot 1291 of the sliding slot 129, engages the thumbscrew 13 and has a rear side, a front side and multiple teeth 211. The teeth 211 are formed on and protrude from the rear side of the sliding bar 21 at intervals, extend into the mounting recess 128 and engage the thumbscrew 13 to enable the sliding bar 21 to move relative to the head 12 when the thumbscrew 13 is rotated relative to the head 12.

The ribbed slab 22 is formed on and protrudes from the front side of the sliding bar 21, is mounted in the board-shaped slot 1292 of the sliding slot 129 and has a front side, an inner side and a dodge notch 23. The front side of the ribbed slab 22 extends out of the front side of the connecting block 121 via the board-shaped slot 1292 of the sliding slot 129. The inner side of the ribbed slab 22 faces the curved slot 123 of the head 12. The dodge notch 23 is formed in the inner side of the ribbed slab 22 to prevent the ribbed slab 22 interfering with the curved slot 123 when the ribbed slab 22 moves inwardly to the fixed jaw 122 with the sliding bar 21.

The movable jaw 24 is formed on and protrudes from the ribbed slab 22 at a side that is opposite to the sliding bar 21, faces the fixed jaw 122 to hold and rotate a hexangular head 40 of a bolt and has a rear end, a front end, an inner side, an engaging surface 241, a limiting protrusion 242, a front notch 243, multiple limiting notches 244, a positioning block 245 and a rear notch 246.

Figure 4:
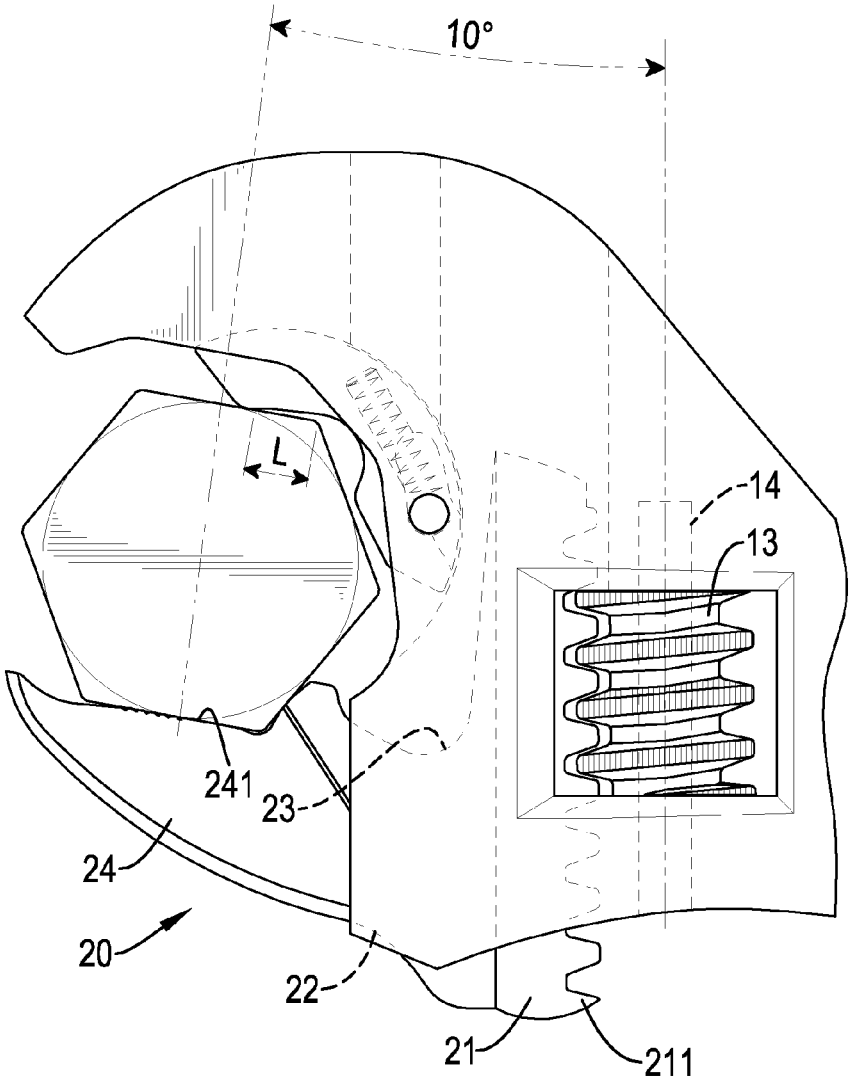
FIG. 4 is another enlarged top view of the adjustable wrench in FIG. 1.
Figure 5:
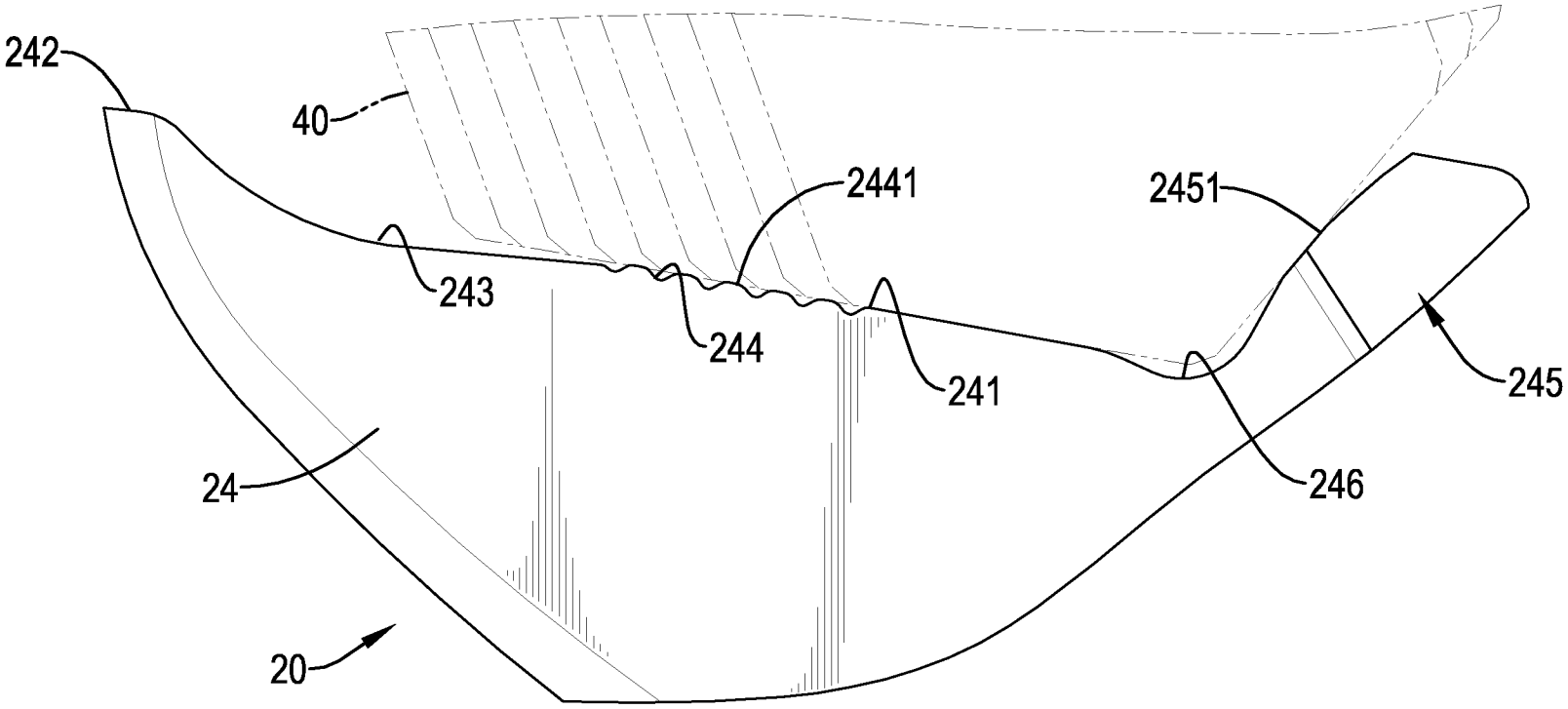
FIG. 5 is a further enlarged top view of the adjustable wrench in FIG. 3.

The rear end of the movable jaw 24 is formed on and protrudes from the front side of the ribbed slab 22. The engaging surface 241 is formed on the inner side of the movable jaw 24 between the rear end and the front end of the movable jaw 24, faces the inner side of the fixed jaw 122 and the curved slot 123 and has a normal line perpendicular to the engaging surface 241. With reference to FIG. 4, an angle range between the normal line of the engaging surface 241 and the axial line of the thumbscrew 13 is between 7 and 15 degrees. Preferably, the angle range is between 9 and 11 degrees. Furthermore, in the first embodiment of the adjustable wrench in accordance with the present invention, the angle between the normal line of the engaging surface 241 and the axial line of the thumbscrew 13 is 10 degrees.

The limiting protrusion 242 is formed on the front end of the movable jaw 24. The front notch 243 is formed in the inner side of the movable jaw 24 between the limiting protrusion 242 and the engaging surface 241 of the movable jaw 24. The limiting notches 244 are formed in the engaging surface 241 at intervals adjacent to the front notch 243 to form multiple limiting claws 2441 between the limiting notches 244. The positioning block 245 is formed on and protrudes from the inner side of the movable jaw 24 at the rear end of the movable jaw 24 and has an inner side and a positioning surface 2451. The positioning surface 2451 is formed on the inner side of the positioning block 245. An angle between the positioning surface 2451 of the positioning block 245 and the engaging surface 241 of the movable jaw 24 is 120 degrees. The rear notch 246 is formed in the inner side of the movable jaw 24 between the engaging surface 241 and the positioning block 245.

The ratcheting jaw 30 is a curved block capable of sliding forward and retracting backward inside the curved slot 123 of the head 12 and has a backward area, a forward area, an outer surface, an inner surface, a top face, a bottom face, a guide hole 31, an abutting protrusion 32, an engaging surface 33, an abutting surface 34, an engaging protrusion 35, a spring recess 36, a spring 37 and an inner notch 38. The backward area of the ratcheting jaw 30 is defined within the ratcheting jaw 30, as an area heading toward the backward direction during a ratcheting rotation of the head 12 in the backward direction. Opposite to the backward area, the forward area of the ratcheting jaw 30 is defined within the ratcheting jaw 30 as an area heading toward the forward direction while the head 12 is being rotated in the forward direction.

The outer surface of the ratcheting jaw 30 has a shape that corresponds to the inner surface of the curved slot 123 to allow the ratcheting jaw 30 to slide inside the curved slot 123 of the head 12. The inner surface of the ratcheting jaw 30 faces the inner side of the movable jaw 24 to enable the hexangular head 40 of the bolt to be held between the inner surface of the ratcheting jaw 30 and the inner side of the movable jaw 24.

The guide hole 31 is a curved hole, is formed through the top face and the bottom face of the ratcheting jaw 30 and has a backward area and a forward area. The backward area of the guide hole 31 is defined within the guide hole 31, as an area heading toward the backward direction during a ratcheting rotation of the head 12 in the backward direction. Opposite to the backward area, the forward area of the guide hole 31 is defined within the guide hole 31 as an area heading toward the forward direction while the head 12 is being rotated in the forward direction. The positioning pin 127 is mounted through the guide hole 31 via the pin holes 126. More precisely, the positioning pin 127 is mounted through the curved slot 123 and the forward area of the guide hole 31.

The abutting protrusion 32 is formed on and protrudes from the inner surface of the ratcheting jaw 30 at the forward area of the ratcheting jaw 30 and extends out of the curved slot 123 of the head 12. The engaging surface 33 is formed in the inner surface of the ratcheting jaw 30 adjacent to the backward area of the ratcheting jaw 30. The abutting surface 34 is formed in the inner surface of the ratcheting jaw 30 at the backward area of the ratcheting jaw 30 and is opposite to the abutting protrusion 32. The engaging protrusion 35 is formed on and protrudes from the inner surface of the ratcheting jaw 30 between the engaging surface 33 and the abutting surface 34.

The spring recess 36 is formed in the outer surface of the ratcheting jaw 30 at the forward area of the ratcheting jaw 30 and communicates with the guide hole 31. The spring 37 is mounted in the spring recess 36 and abuts the positioning pin 127 to push the ratcheting jaw 30 to move forwardly. The inner notch 38 is formed in the inner surface of the ratcheting jaw 30 between the engaging surface 33 and the abutting protrusion 32.

Figure 9:
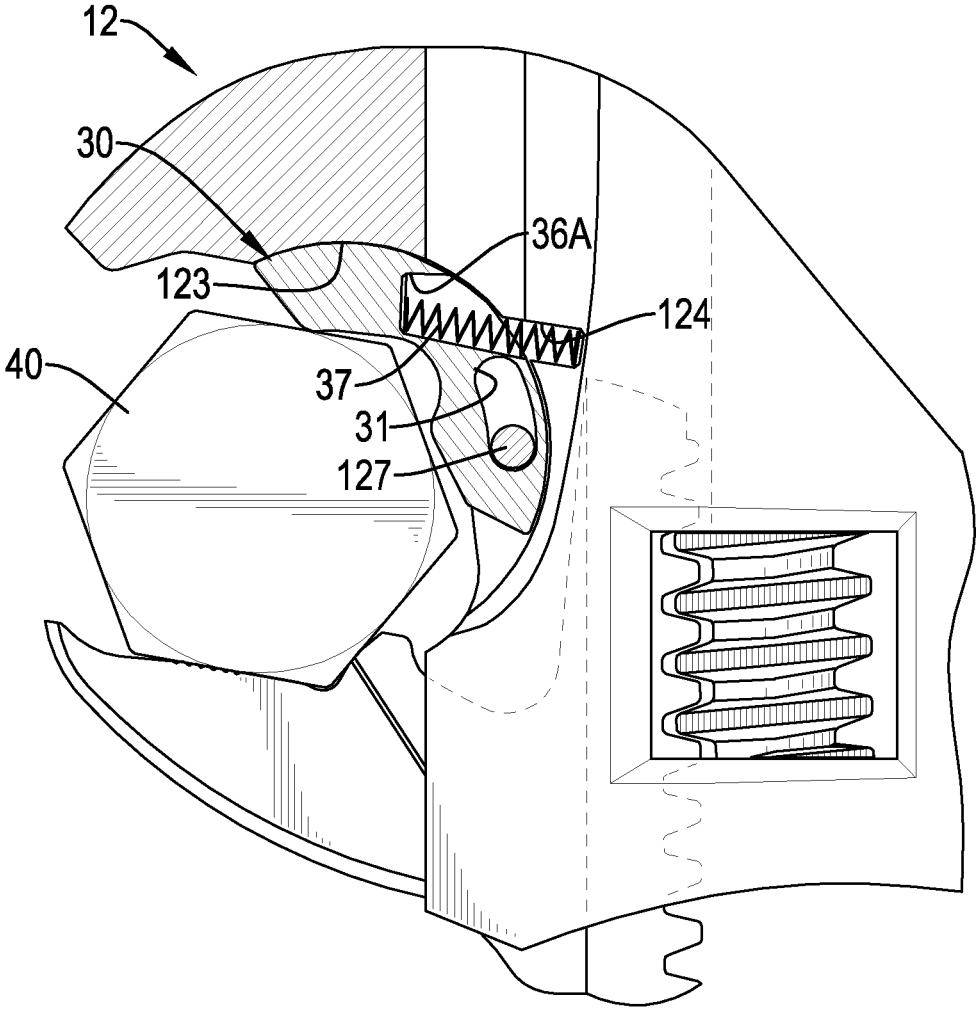
FIG. 9 is an enlarged top view in partial section of a second embodiment of an adjustable wrench in accordance with the present invention.

With reference to FIG. 9, a second embodiment of an adjustable wrench in accordance with the present invention has similar structures as the first embodiment of the adjustable wrench in accordance with the present invention, except the spring recess 36A is formed in the outer surface of the ratcheting jaw 30 at the forward area of the ratcheting jaw 30 without communicating with the guide hole 31, the head 12 further has a bottom recess 124 formed in the inner surface of the curved slot 123 and communicates with the spring recess 36A and the spring 37 is mounted between the bottom recess 124 of the head 12 and the spring recess 36A of the ratcheting jaw 30.

Figure 3:
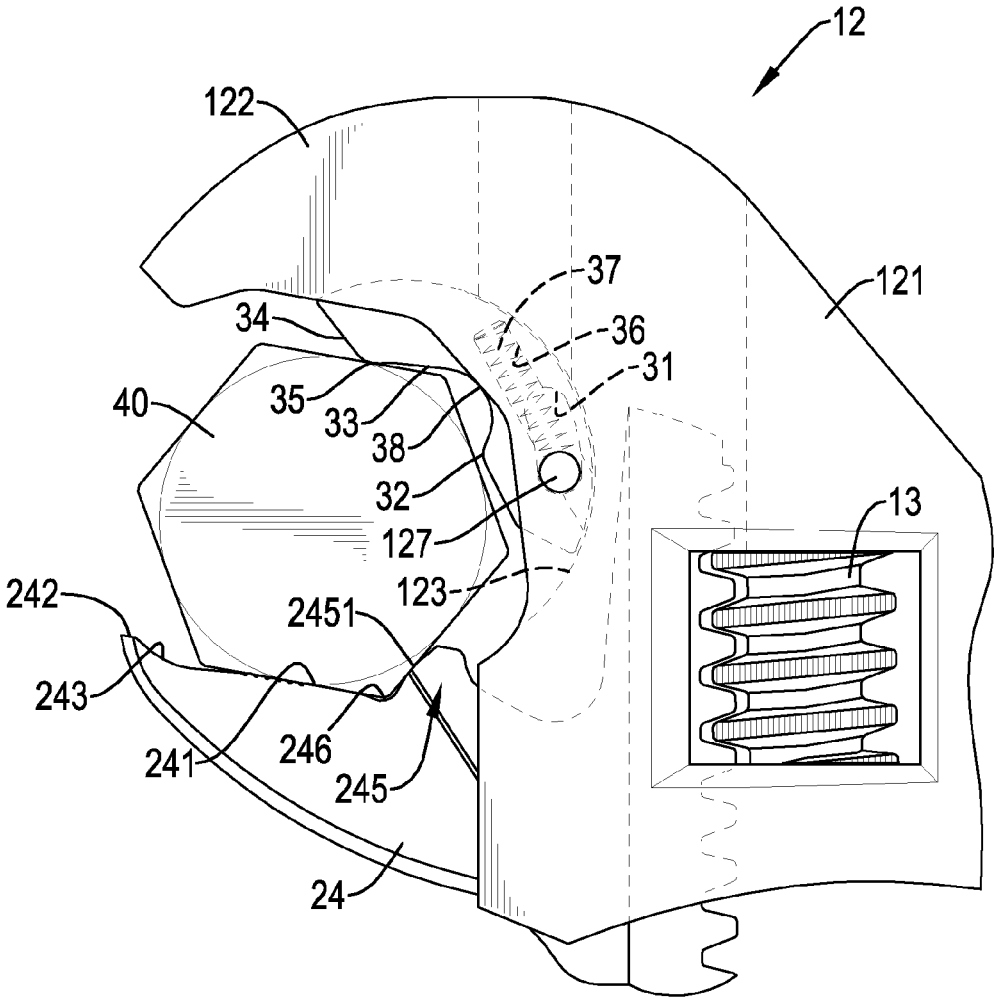
FIG. 3 is an enlarged top view of the adjustable wrench in FIG. 1.

A hexangular head 40, 40A of a bolt has multiple flats and multiple corners formed between adjacent flats. When engaging the hexangular head 40, 40A of the bolt between the ratcheting jaw 30 and the movable jaw 24 of the clamping element 20, the engaging protrusion 35 and the engaging surface 241 will respectively engage a top and a bottom of the hexangular head 40, 40A of the bolt. With reference to FIG. 3, when the hexangular head 40, 40A of the bolt is mounted between the jaws 30, 24, a flat that is formed at a rear side of the hexangular head 40, 40A of the bolt will be pressed against by the positioning surface 2451 of the movable jaw 24. With reference to FIG. 4, the length percentage (L) of the engaging protrusion 35 contacting and engaging the hexangular head 40, 40A is between 35~50% of the length of the corresponding flat of the hexangular head 40, 40A of the bolt that is pressed against by the engaging protrusion 35. When the jaws 24, 30 engage a larger-size bolt, a corner of the hexangular head 40, 40A of the larger-size bolt is mounted on the front notch 243 of the movable jaw 24. When the jaws 24, 30 engage a small-size bolt, a corner of the hexangular head 40, 40A of the larger-size bolt is mounted on one of the limiting notches 244 of the movable jaw 24. In addition, with reference to FIGS. 3 and 5, a corner of a small-size bolt is mounted on the rear notch 246 of the movable jaw 24 and another corner of the small-size bolt is mounted on the upper notch 38 of the ratcheting jaw 30. With reference to FIG. 4, the ribbed slab 22 has a dodge notch 23 corresponding to the curved slot 123, and this can be used to avoid the ratcheting jaw 30 knocking against the clamping element 20 when the ratcheting jaw 30 moves relative to the head 12 and moves forwardly to the ribbed slab 22.

Figure 6A:
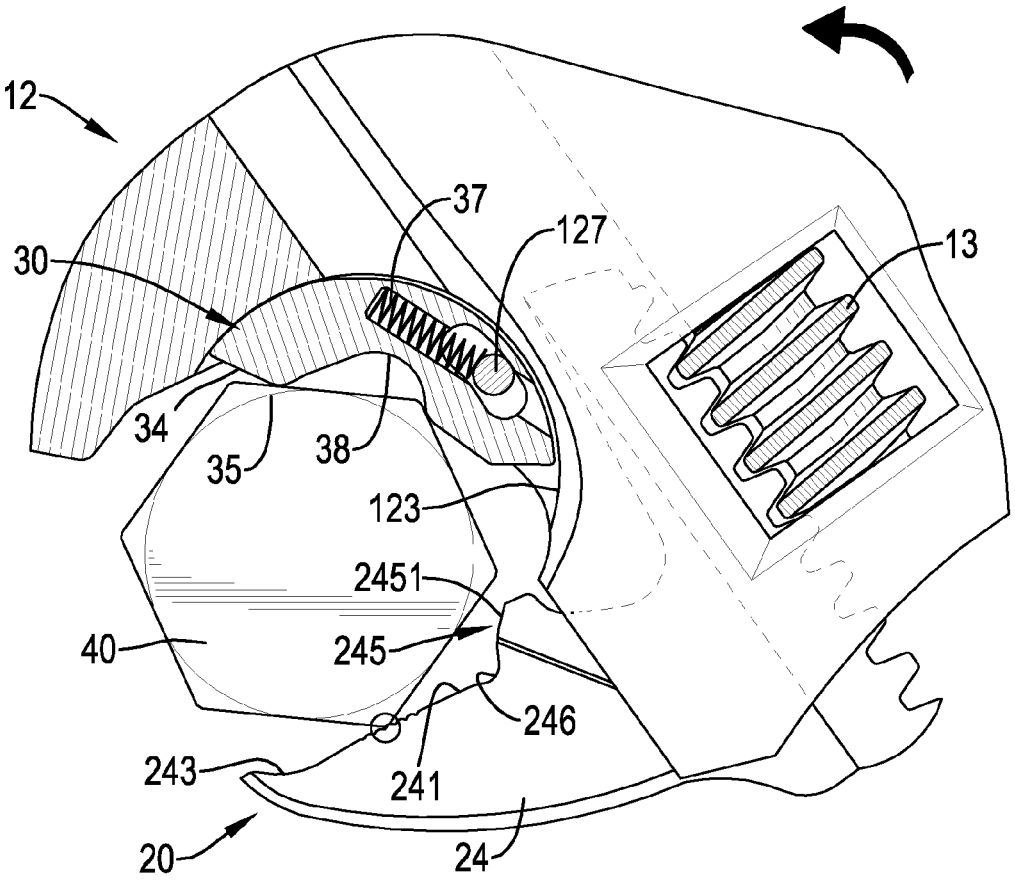
FIG. 6A is an operational top view in partial section of the adjustable wrench in FIG. 1 being rotated in a backward direction with a larger-size bolt.

In the present invention, we define that a bolt is rotated to be fastened in a forward direction, for example, clockwise, and is rotated to be loosened in a counterclockwise direction as shown in FIG. 6A. With reference to FIGS. 1 and 3, a user holds the handle 11 of the wrench body 10 and mounts a hexangular head 40 of a bolt between the ratcheting jaw 30 and the clamping element 20. At this time, the user can rotate the thumbscrew 13 to enable the movable jaw 24 to move toward the hexangular head 40 of the bolt. Then, two of the flats of the hexangular head 40 can be respectively pressed between the engaging surface 241 of the movable jaw 24 and the engaging protrusion 35 of the ratcheting jaw 30. In addition, the positioning surface 2451 of the positioning block 245 will abut one of the flats of the hexangular head 40. When the hexangular head 40 is mounted between the jaws 24, 30, one of the flats of the hexangular head 40 will touch the abutting protrusion 32, and this will enable the ratcheting jaw 30 to rotate backwardly relative to the head 12. Then, the engaging protrusion 35 can be pushed downwardly to engage the corresponding flat of the hexangular head 40 assuredly.

The adjustable wrench in accordance with the present invention can be applied to the hexangular heads of bolts of all sizes. For example, when the size of the hexangular head 40 is between 8 and 19 millimeters, the angle range between the normal line of the engaging surface 241 and the axial line of the thumbscrew 13 is between 7 and 15 degrees, and this can enable the engaging protrusion 35 of the ratcheting jaw 30 to engage hexangular heads 40 of different sizes at the position where the length percentage (L) of the engaging protrusion 35 contacting and engaging the hexangular heads 40 is between 35~50% of the length of the corresponding flat of the hexangular heads 40. When the head 12 is rotated backwardly, the hexangular head 40 can push the ratcheting jaw 30 to rotate forwardly in a clockwise direction to move into the curved slot 123 of the head 12, and this can prevent the ratcheting jaw 30 from sticking with the hexangular heads 40 and can avoid the head 12 rotating difficulty. Because the rotating radian of the ratcheting jaw 30 is same as the rotating radian of the head 12, the ratcheting jaw 30 and the movable jaw 24 can be used to hold and engage the hexangular heads 40 of different sizes.

When the user rotates the head 12 in a clockwise direction to fasten the bolt, the hexangular head 40 of the bolt is rotated with the same direction. Because the length percentage (L) of the engaging protrusion 35 contacting and engaging the hexangular heads 40 is between 35~50% of the length of the corresponding flat of the hexangular head 40, the hexangular head 40 of the bolt can be rotated smoothly in a clockwise direction. During the rotating process, the corners of the hexangular head 40 are respectively moved at the notches 243, 246, 38 and this can prevent the corners of the hexangular head 40 from knocking against the jaws 24, 30.

Figure 6B:
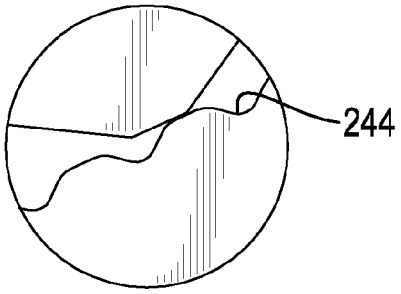
FIG. 6B is an enlarged and operational top view of the adjustable wrench in FIG. 6A.

With reference to FIGS. 6A and 6B, when the head 12 is rotated backwardly in a counterclockwise direction at the original position, the hexangular head 40 will abut the abutting surface 34 to push the ratcheting jaw 30 to rotate forwardly in a clockwise direction into the curved slot 123 to press the spring 37. Because the ratcheting jaw 30 is rotated and moved along the curved inner surface of the curved slot 123, this can fit with the rotating direction of the head 12 to enable the head 12 to rotate in a counterclockwise direction by a minimum action.

During the above-mentioned rotating process (the head 12 is rotated in a counterclockwise direction), the front notch 243 can press and push the corner of the hexangular head 40 to move inwardly to the rear end of the movable jaw 24 and can prevent the hexangular head 40 from slipping out of the jaws 24, 30. In addition, the inner notch 38 and the rear notch 246 also can be used to yield the corners of the hexangular head 40 when the hexangular head 40 is rotated with the movable jaw 24 and the ratcheting jaw 30 and this can prevent the corners of the hexangular head 40 from wearing and tearing by the jaws 24, 30. After rotating the head 12 backwardly in a counterclockwise direction, the user can rotate the head 12 forwardly in a clockwise direction to enable the engaging protrusion 35 of the ratcheting jaw 30, the engaging surface 241 and the positioning surface 2451 of the movable jaw 24 to press the flats of the hexangular head 40. Then, the head 12 can be rotated again in a clockwise direction by the user to rotate the hexangular head 40 of the bolt.

Figure 7A:
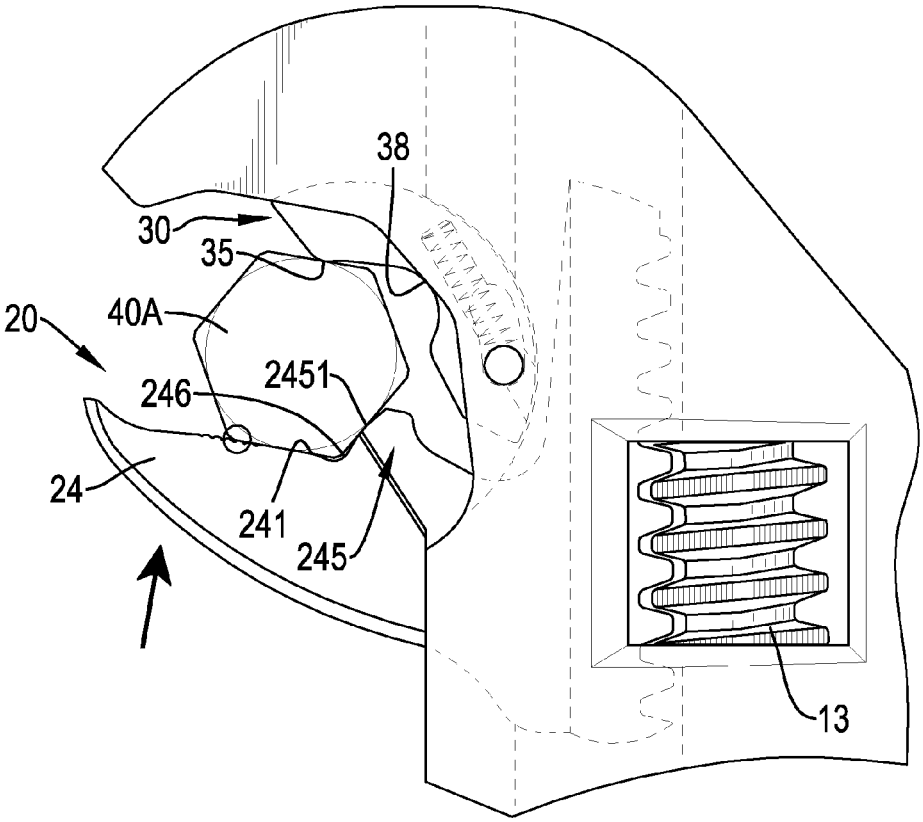
FIG. 7A is an operational top view of the adjustable wrench in FIG. 1 being rotated in a backward direction with a small-size bolt.
Figure 7B:
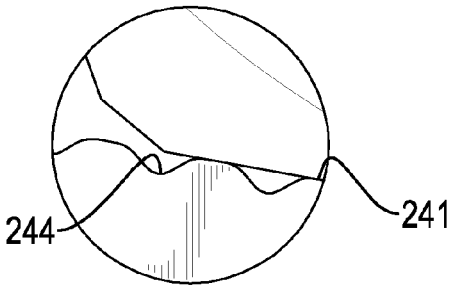
FIG. 7B is an enlarged and operational top view of the adjustable wrench in FIG. 7A.

With reference to FIGS. 7A and 7B, when the adjustable wrench in accordance with the present invention is used on a bolt having a small-size hexangular head 40A, in the same way, the small-size hexangular head 40A is mounted between the ratcheting jaw 30 and the clamping element 20 and the thumbscrew 13 is rotated to enable the movable jaw 24 to move toward the hexangular head 40A. Then, two of the flats of the small-size hexangular head 40A can be respectively pressed between the engaging surface 241 of the movable jaw 24 and the engaging protrusion 35 of the ratcheting jaw 30. In addition, the positioning surface 2451 of the positioning block 245 will abut one of the flats of the hexangular head 40A. Because the positioning surface 2451 abuts the corresponding flat of the small-size hexangular head 40A, the hexangular head 40A can be prevented from moving inwardly between the jaws 24, 30. Then, the length percentage (L) of the engaging protrusion 35 contacting and engaging the small-size hexangular heads 40A is still controlled between 35~50% of the length of the corresponding flat of the small-size of hexangular heads 40A. Therefore, the small-size hexangular head 40A can be rotated smoothly in a clockwise direction.

Figure 8:
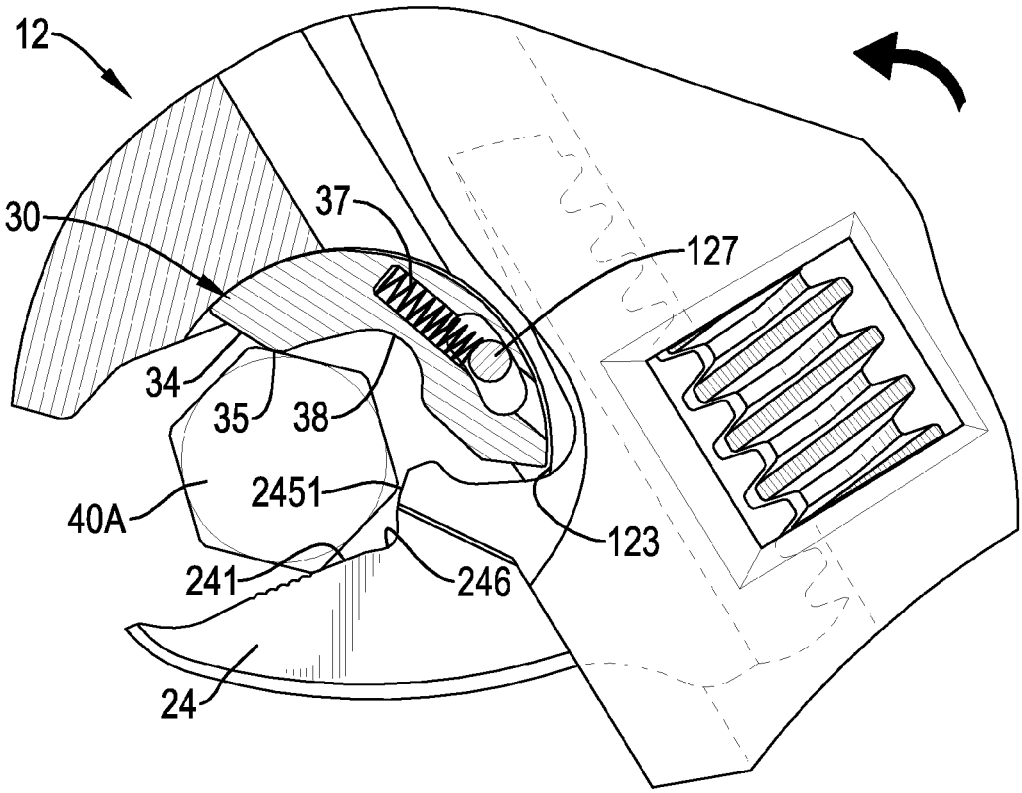
FIG. 8 is another operational top view in partial section of the adjustable wrench in FIG. 7A being rotated in a backward direction with a small-size bolt.

With reference to FIGS. 7A, 7B and 8, the operational principle of fastening or loosening the small-size hexangular head 40A is same as the above-mentioned operation of fastening or loosening the ordinary-size hexangular head 40. The exception is that when the head is rotated in a counterclockwise direction, the limiting notch 244 can press and push the corner of the small-size hexangular head 40A to move inwardly to the rear end of the movable jaw 24 and can prevent the hexangular head 40A from slipping out of the jaws 24, 30.

With reference to FIG. 9, the operational principle of the second embodiment of the adjustable wrench in accordance with the present invention is same as the first embodiment of the adjustable wrench in accordance with the present invention.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An adjustable wrench having
- a wrench body having
  - a handle having a front end;
  - a head formed on the front end of the handle and having
    - a connecting block formed on and protruding from the front end of the handle and having
      - an upper side;
      - a front side;
      - a top side; and
      - a bottom side;
    - a fixed jaw formed on and protruding from the upper side of the connecting block and having an inner side;
    - a curved slot formed in the connecting block and the fixed jaw between the front side of the connecting block and the inner side of the fixed jaw and having an inner surface being curved;
      - a forward end formed in the front side of the connecting block, being opposite to the fixed jaw and as an end heading toward the backward direction during a ratcheting rotation of the head in the backward direction; and
      - a backward end formed in the inner side of the fixed jaw and as an end heading toward the forward direction while the head is being rotated in the forward direction;
    - a positioning pin inserted through the curved slot;
    - a mounting recess formed though the top side and the bottom side of the connecting block; and
    - a sliding slot formed though the front side of the connecting block, communicating with the curved slot and the mounting recess; and
  - a thumbscrew rotatably mounted in the mounting recess of the head, extending into the sliding slot and having an axial line;
- a clamping element movably connected to the wrench body and having
  - a rear end;
  - a sliding bar formed on the rear end of the clamping element, slidably mounted in the sliding slot and engaging the thumbscrew and having
    - a rear side; and
    - multiple teeth formed on and protruding from the rear side of the sliding bar at intervals, extending into the mounting recess and engaging the thumbscrew to enable the sliding bar to move relative to the head when the thumbscrew is rotated relative to the head;
  - a movable jaw formed with the sliding bar, facing the fixed jaw and having
    - a rear end;
    - a front end;
    - an inner side;
    - an engaging surface formed on the inner side of the movable jaw between the rear end and the front end of the movable jaw, facing the inner side of the fixed jaw and the curved slot and having
      - a normal line perpendicular to the engaging surface; and
      - an angle range between the normal line of the engaging surface and the axial line of the thumbscrew being between 7 and 15 degrees;
    - a limiting protrusion formed on the front end of the movable jaw;
    - a front notch formed in the inner side of the movable jaw between the limiting protrusion and the engaging surface of the movable jaw;
    - a positioning block formed on and protruding from the inner side of the movable jaw at the rear end of the movable jaw and having
      - an inner side; and
      - a positioning surface formed on the inner side of the positioning block; and
    - a rear notch formed in the inner side of the movable jaw between the engaging surface and the positioning block; and a ratcheting jaw being a curved block capable of sliding forward and retracting backward inside the curved slot of the head and having a backward area being defined within the ratcheting jaw, as an area heading toward the backward direction during a ratcheting rotation of the head in the backward direction;

a forward area being defined within the ratcheting jaw as an area heading toward the forward direction while the head is being rotated in the forward direction;

an outer surface having a shape corresponding to the inner surface of the curved slot to allow the ratcheting jaw to slide inside the curved slot of the head;

an inner surface facing the inner side of the movable jaw;

a top face;

a bottom face;

a guide hole being a curved hole, formed through the top face and the bottom face of the ratcheting jaw to enable the positioning pin to be mounted through the guide hole and having a backward area being defined within the guide hole as an area heading toward the backward direction during a ratcheting rotation of the head in the backward direction; and a forward area defined within the guide hole as an area heading toward the forward direction while the head is being rotated in the forward direction;

an engaging surface formed in the inner surface of the ratcheting ratcheting jaw adjacent to the backward area of the ratcheting jaw;

an abutting surface formed in the inner surface of the ratcheting jaw at the backward area of the ratcheting jaw;

an engaging protrusion formed on and protruding from the inner surface of the ratcheting jaw between the engaging surface and the abutting surface;

a spring mounted between the ratcheting jaw and the head to move forwardly; and an inner notch formed in the inner surface of the ratcheting jaw adjacent to the engaging surface;

whereby, when the adjustable wrench is applied to hold a bolt having a hexangular head with multiple flats and multiple corners formed between the adjacent flats to engage the hexangular head between the ratcheting jaw and the movable jaw of the clamping element, the engaging protrusion and the engaging surface respectively engage a top and a bottom of the hexangular head of the bolt, and a length percentage of the engaging protrusion contacting and engaging the hexangular head is between 35~50% of a length of the flat of the hexangular head of the bolt that is pressed against by the engaging protrusion.

2. The adjustable wrench as claimed in claim 1, wherein the movable jaw has multiple limiting notches formed in the engaging surface at intervals adjacent to the front notch to form multiple limiting claws between the limiting notches.

3. The adjustable wrench as claimed in claim 2, wherein the ratcheting jaw has an abutting protrusion formed on and protruding from the inner surface of the ratcheting jaw at the forward area of the ratcheting jaw and extending out of the curved slot of the head;

the abutting surface is formed in the inner surface of the ratcheting jaw at the backward area of the ratcheting jaw and is opposite to the abutting protrusion; and the inner notch is formed in the inner surface of the ratcheting jaw between the the engaging surface and the abutting protrusion.

4. The adjustable wrench as claimed in claim 3, wherein the sliding slot has a bar-shaped slot formed though the connecting block and communicating with the mounting recess; and a board-shaped slot formed through the front side of the connecting block and communicating with the curved slot and the bar-shaped slot;

the sliding bar is formed on the rear end of the clamping element, is slidably mounted in the bar-shaped slot of the sliding slot;

the clamping element has a ribbed slab formed on and protruding from the front side of the sliding bar, mounted in the board-shaped slot of the sliding slot and having a front side extending out of the front side of the connecting block via the board-shaped slot of the sliding slot;

an inner side facing the curved slot of the head; and a dodge notch formed in the inner side of the ribbed slab to prevent the ribbed slab interfering with the curved slot when the ribbed slab moves inwardly to the fixed jaw with the sliding bar; and the movable jaw is formed on and protrudes from the ribbed slab that is opposite to the sliding bar.

5. The adjustable wrench as claimed in claim 4, wherein the ratcheting jaw has a spring recess formed in the outer surface of the ratcheting jaw at the forward area of the ratcheting jaw and communicating with the guide hole; and the spring is mounted in the spring recess and abuts the positioning pin.

6. The adjustable wrench as claimed in claim 5, wherein the head has two sidewalls respectively formed on a top side and a bottom side of the head beside the curved slot and each sidewall having a middle; and two pin holes respectively formed through the middles of the sidewalls and communicating with the curved slot;

the positioning pin is mounted through the guide hole via the pin holes and is mounted through the curved slot and the forward area of the guide hole;

the mounting recess has two opposite inner sides facing to each other; and two inserting holes respectively formed through the opposite inner sides of the mounting recess, formed through the connecting block and aligning with each other;

the thumbscrew has a pivot hole axially formed through the thumbscrew along the axial line and aligning with the inserting holes of the mounting recess;

the wrench body has an inserting pin mounted in the inserting holes of the head and through the pivot hole of the thumbscrew to enable the thumbscrew to be rotatably mounted in the head; and an angle between the positioning surface of the positioning block and the engaging surface of the movable jaw is 120 degrees.

7. The adjustable wrench as claimed in claim 4, wherein the ratcheting jaw has a spring recess formed in the outer surface of the ratcheting jaw at the forward area of the ratcheting jaw;

the head has a bottom recess formed in the inner surface of the curved slot and communicating with the spring recess; and the spring is mounted between the bottom recess of the head and the spring recess of the ratcheting jaw.

8. The adjustable wrench as claimed in claim 7, wherein the head has two sidewalls respectively formed on a top side and a bottom side of the head beside the curved slot, and each sidewall having a middle; and two pin holes respectively formed through the middles of the sidewalls and communicating with the curved slot;

the positioning pin is mounted through the guide hole via the pin holes and is mounted through the curved slot and the forward area of the guide hole;

the mounting recess has two opposite inner sides facing to each other; and two inserting holes respectively formed through the opposite inner sides of the mounting recess, formed through the connecting block and aligning with each other;

the thumbscrew has a pivot hole axially formed through the thumbscrew along the axial line and aligning with the inserting holes of the mounting recess;

the wrench body has an inserting pin mounted in the inserting holes of the head and through the pivot hole of the thumbscrew to enable the thumbscrew to be rotatably mounted in the head; and an angle between the positioning surface of the positioning block and the engaging surface of the movable jaw is 120 degrees.

* * * * *